United States Patent [19]

Flumm

[11] 4,250,575

[45] Feb. 10, 1981

[54] ILLUMINATOR FOR ANALOG TIMEPIECE DIAL

[75] Inventor: Paul Flumm, Oakville, Conn.

[73] Assignee: Timex Corporation, Middlebury, Conn.

[21] Appl. No.: 56,561

[22] Filed: Jul. 11, 1979

[51] Int. Cl.[3] ..... G04B 19/30

[52] U.S. Cl. ..... 368/227

[58] Field of Search ..... 58/50 R, 127 R; 362/23, 362/26, 267; 368/227

[56] References Cited

U.S. PATENT DOCUMENTS

| | | | |
|---|---|---|---|
| 363,959 | 5/1887 | Humbert | 58/50 R |
| 2,083,924 | 6/1937 | Scantlebury | 58/50 R |
| 2,259,910 | 10/1941 | Rylsky | 362/267 |
| 3,214,577 | 10/1965 | Pbotzmann | 58/50 R |
| 3,224,184 | 12/1965 | Brien | 58/50 R |
| 3,452,538 | 7/1969 | Frey | 58/54 |
| 3,574,993 | 4/1971 | Black | 58/50 R |

*Primary Examiner*—Vit W. Miska

*Attorney, Agent, or Firm*—Edward J. Timmer

[57] ABSTRACT

An analog watch or clock is provided with an improved dial illiminator in the form of a molded clear plastic dial cap having a tubular section surrounding and extending axially behind the periphery of the dial and an annular rim section projecting inwardly from the tubular section over and in contact with the dial, and a point light source such as a minature incandescent bulb positioned behind the dial in a recess formed in the tubular section of the dial cap. The rim section of the dial cap typically includes a truncated-conical, light-reflecting outer peripheral surface for reflecting light from the tubular section into the rim section and an inner peripheral surface which defines a central aperture through which the shaft supporting the watch or clock hands passes. In operation, the tubular section of the dial cap functions to distribute light around the entire periphery of the dial while the rim section receives the peripheral light and directs it over the dial toward its center for illumination purposes.

To maximize dial illumination, a reflector cap having a corresponding tubular section and rim section is placed around the dial cap. In addition, a transparent, light-transmitting material can be placed between the rim section of the dial cap and the dial to provide optimum optical communication there between.

15 Claims, 4 Drawing Figures

ILLUMINATOR FOR ANALOG TIMEPIECE DIAL

FIELD OF THE INVENTION

The present invention relates to timepieces of the analog type which use a dial with time indicia thereon in conjunction with time indicator hands for time display and, more particularly, to dial illumination schemes for use with such timepieces under low ambient light conditions.

DESCRIPTION OF THE PRIOR ART

Workers in the horological field have long recognized the desirability of providing a wristwatch of the analog type with some means for illuminating the dial and watch hands at night or under other adverse ambient light conditions. As a result, a number of approaches have been employed in the past for the purpose of providing dial illumination.

One approach is represented by the Wegner U.S. Pat. No. 2,974,474 issued Mar. 14, 1961 and the Cattin U.S. Pat. No. 3,514,939, issued June 2, 1970 and involves providing an opening in the dial through which a small incandescent light bulb projects above the dial to provide illumination. In the Wegner patent, the light bulb is positioned on the periphery of the dial, usually in the vicinity of the 12 or 3 o'clock hour marker, whereas in the Cattin patent, the light source extends through a large dial between a pair of smaller dials mounted thereon, one of which smaller dials displays the time in analog fashion and the other additional information such as ambient air temperature. In a somewhat similar manner, the Wegner U.S. Pat. No. 2,916,871 issued Dec. 15, 1959 shows an incandescant bulb mounted in an insulating ring around the periphery of the dial. A clear plastic watch crystal is engaged peripherally against a polished, truncated-conical bezel surface and includes a relatively thick rim portion and small lens proturbence adjacent the polished bezel surface, beneath which rim and lens the light bulb is disposed. The patent indicates that a portion of the light from the incandescent bulb is directed into the crystal rim and reflected from the polished bezel surface adjacent thereto toward the center of the dial for dial illumination purposes while the remainder of the light passes through the rim and out through the lens so that the watch can also serve as a miniature flashlight. Likewise, the Cummingham U.S. Pat. No. 1,081,021 issued Dec. 9, 1913 illustrates peripheral light sources and reflectors for illuminating the dial of a clock.

The Brien U.S. Pat. No. 3,748,456 issued July 24, 1973 provides a dial illumination assembly comprising an annular, hollow transluscent plastic tube with a miniature incandescent light bulb enclosed in its hollow porton and the placement of the assembly in a groove in the bezel outside but adjacent to the watch crystal so that light can be transmitted onto a dial sealed within the crystal. The plastic tube-light bulb assembly is placed around the exterior of the watch crystal to facilitate replacement of the assembly when the bulb burns out. The Fleishman U.S. Pat. No. 3,025,662 issued Mar. 20, 1962 and the Brigliano U.S. Pat. No. 3,729,923 issued May 1, 1973 also describe dial illumination schemes exteriorly disposed to the watch crystal.

Another approach to dial illumination involves attaching a light source to the watch crystal above the dial. For example, the Brien U.S. Pat. Nos. 3,018,614 and 3,224,184 issued Jan. 30, 1961 and Dec. 21, 1965, respectively, show a light filament or complete minature light bulb enclosed and sealed in recess in the watch crystal near the 12 o'clock position. The Tomlinson U.S. Pat. No. 4,115,994 issued Sept. 26, 1976 and the Foellner U.S. Pat. No. 4,118,924 issued Oct. 10, 1978 illustrate dial illumination systems in which a light source is attached to the center of the watch crystal with special light reflectors around the dial periphery or on the dial itself to distribute light onto the dial and watch hands.

The Huther U.S. Pat. No. 3,609,960 issued Oct. 5, 1971 provides a transluscent dial having a peripheral recess for receiving an incandescent bulb and blind bores in the dial arranged beneath the hour markers to reflect light from the bulb upwardly through or around the markers.

Still another approach involves placing a light source behind a transparent dial plate to provide backlighting. In the Black U.S. Pat. No. 3,574,993, a transluscent light-diffuser plate is placed immediately behind a transparent dial plate of an analog clock. The diffuser plate includes a rearwardly extending light-transmitting member having a recess therein for receiving an incandescent light bulb and also includes a roughened front surface adjacent the dial plate to diffuse light received from the rear extension member and a reflective rear surface to minimize leakage of light from the back of the diffuser plate. Other somewhat similar illumination systems using light emanating from a point source and conducted through a light-transmitting member with light-scattering irregularities on one face and a reflector on the other face are shown in the Marble U.S. Pat. No. 3,043,038 issued July 10, 1962 and the Albinger U.S. Pat. No. 3,043,947 issued July 10, 1962.

In spite of this concerted prior art effort to provide dial illumination for analog watches, none to date has received wide acceptance and commerical use in the watch industry. Many of the above-described dial illumination schemes have been unsatisfactory because illumination of the dial is not uniform, some dial area receiving too much light while others receive too little. In addition, many are expensive to manufacture on a mass production basis and also disadvantageous from the standpoint of unduly increasing the size of the watch or detracting from its overall appearance. Thus, what is still needed is an inexpensive, easily produced dial illumination device providing substantially uniform 360° illumination without adversely affecting aesthetic features of the watch including its size.

The present invention has as one of its primary objects the provision of such a dial illuminator in an analog timepiece. Copending U.S. patent application Ser. No. 056,562 entitled "Dial Illuminator For Analog Timepiece" filed on July 11, 1979 in the name of Noel Eberhardt as inventor and of common assignee herewith has the same primary object and provides a dial illuminator comprising a substantially transparent, light-transmitting annulus positioned around the dial periphery and a point light source disposed at least partially above the dial in a recess in the annulus. The light-transmitting annulus usually is supported directly on the periphery of the dial and includes a roughened, light-diffusing inner peripheral wall which surrounds the dial, time indicia thereon and watch hands and light-reflecting outer peripheral and top and bottom walls. Light from the point light source is reflected and scattered around the dial periphery within the annulus and eventually escapes through and is distributed by the light-diffusing inner peripheral wall toward the center of the dial for illumination of the dial and watch hands.

SUMMARY OF THE INVENTION

Briefly stated, the dial illuminator of the present invention includes (a) a substantially transparent, light-transmitting dial cap which has a tubular section surrounding the periphery of the dial and extending axially therebehind with portions behind the dial defining a recess in said section and an annular rim section which projects from the tubular section over the dial toward its center and (b) a point light source such as miniature incandescent light bulb disposed behind the dial in the recess of the tubular section. The rim section of the dial cap typically includes a light-reflecting outer peripheral surface for reflecting light from the tubular section, into the rim section and over the dial and an inner peripheral surface which defines an axially aligned central aperture through which the rotatable shaft supporting the watch or clock hands passes. Preferably, the rim section also includes top and bottom surfaces which converge toward one another in the direction of the dial center with the bottom surface being contoured to rest on the dial itself in optical communication therewith. The tubular section of the dial cap functions to distribute light from the light source around the periphery of the dial with the rim section receiving such light and directing it over the dial toward its center for illuminating purposes.

Particular preferred embodiments of the invention provide means for maximizing the intensity and uniformity of dial illumination. For example, in one particular embodiment, a reflector ring having a corresponding tubular section and rim section is located around the light-transmitting dial cap to minimize leakage of light and to enhance distribution of light throughout the tubular section and then into the rim section overlying the dial. Furthermore, reflector means can be placed in the recess in the tubular section of the dial cap partially around the light source so that the majority of light is emitted into the tubular section in the circumferential direction, thereby enhancing light distribution around the full dial periphery.

In another preferred embodiment, a transparent, light-transmitting material is placed between the rim section of the dial cap and dial to provide optimum optical communication therebetween and increased intensity and uniformity of illumination.

In still another embodiment of the invention, the end of the tubular section located behind the dial is tapered such that the end converges upwardly toward the dial in the direction away from the light source, i.e., when the light source is disposed at the 9 o'clock position, the length of the tubular section behind the dial is shorter at the 3 o'clock position than the 9 o'clock position. This upward convergence of the end of the tubular section functions to distribute light more evenly to those portions of the tubular section and rim section remote from the light source location.

DESCRIPTION OF THE PREFERRED EMBODIMENTS

Figure 1:
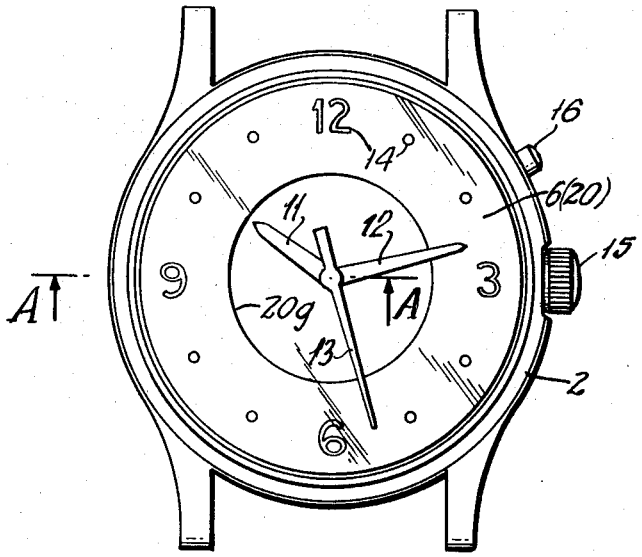
FIG. 1 is a plan view of an analog wristwatch including the dial illuminator of the invention.
Figure 2:
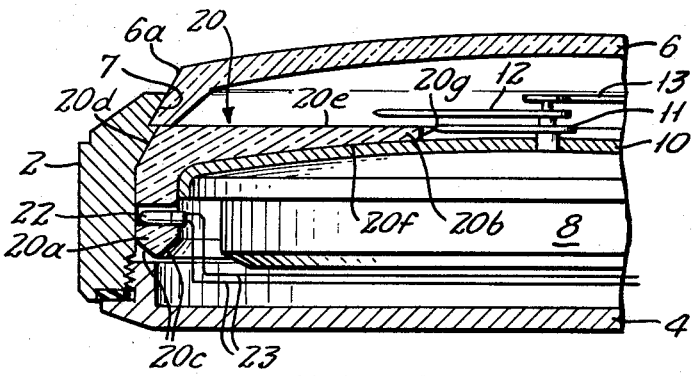
FIG. 2 is a partial cross-section along line A—A in FIG. 1.

FIGS. 1 and 2 illustrate the dial illuminator of the invention as incorporated into an analog wristwatch comprising the ususal components. For example, the wristwatch includes a bezel 2 of metal or plastic having an opening in the front and rear. The rear opening is closed by a caseback 4 which is screwed, snap-fitted or otherwise releasably engaged to the bezel. A clear crystal 6, for example of transparent plastic, closes the front opening and has a peripheral rim 6*a* which is engaged by friction fit in a bezel surface 7 in the bezel in well-known fashion. Mounted in the bezel 2 beneath crystal 6 is a conventional movement 8 which supports a dial plate 10 beneath the crystal and supports and drives time indicator hands such as hour hands 11, minute hand 12 and seconds hand 13 above the dial for the display of time. The dial plate 10 as well as bezel 2, crystal 6 and caseback 4 are circular in shape, the dial plate carrying a circular pattern of time indicia 14 for example numerals or other markers painted near the dial periphery for cooperation with the watch hands to display the time. Of course, shapes other than circular may be utilized for the aforementioned watch components.

A conventional crown 15 is mechanically connected to the movement for the usual setting and adjusting of the watch hands. A push-button switch 16 is also provided for purposes described below.

The dial illuminator includes as one essential component a substantially transparent, light-transmitting dial cap 20, preferably made of molded clear plastic, disposed around and over the dial plate 10. Importantly, the dial cap includes a tubular section 20*a* which surrounds the dial plate and extends axially therebehind into the watch interior and a rim section 20*b* projecting from the tubular section over and in contact with the dial plate 10 toward its center. The tubular section 20*a* includes a radially oriented recess therethrough adapted to receive a point light source such as a miniature incandescent bulb 22 having leads 23 which are connected in series to the push-button switch 16 and a battery (not shown) so that the bulb can be manually activated under low ambient light conditions. The end of the tubular section terminating inside the watch includes chamfered reflecting surfaces 20*c*, for example intersecting at 45°, reflect downward light rays back into the tubular section. In the present embodiment where the bezel and other watch components are generally circular in shape, the inner and outer peripheral walls of the tubular section are cylindrical. The function of the tubular section of the dial cap 20 is to distribute light from the bulb 22 around the entire periphery of the dial plate 10. To this end, the aforementioned surfaces of the tubular section may be polished if desired.

Light from the tubular section 20*a* is received by the annular rim section 20*b* at the periphery of the dial plate and is directed through the rim section and over the dial toward its center for illumination purposes. The rim section 20*b* includes a truncated-conical or other suitably shaped outer peripheral surface 20*d* to reflect light transmitted up the tubular section radially into the rim section. The top and bottom surfaces 20*e* and 20*f*, resepectively, of the rim section preferably converge toward one another in the direction of the dial center to foster internal reflection of the entering light down onto the dial plate 10 and time indicia 14. To this end, the top surface is flat and horizontal whereas the bottom surface is contoured to match the contour of the dial and rest intimately thereon. Preferably, the angle of convergence between the top and bottom surfaces is from about 3 to 5 degrees. The rim section also includes a generally upright inner peripheral surface **20*g* which defines a central opening through which the rotatable shaft of the movement 8 passes. As shown, one or more of the watch hands can be disposed to rotate within the central opening. If desired, the surfaces 20*d*, 20*e*, 20*f*, 20*g*** of rim section may be highly polished to enhance illuminating efficiency.

Figure 3:
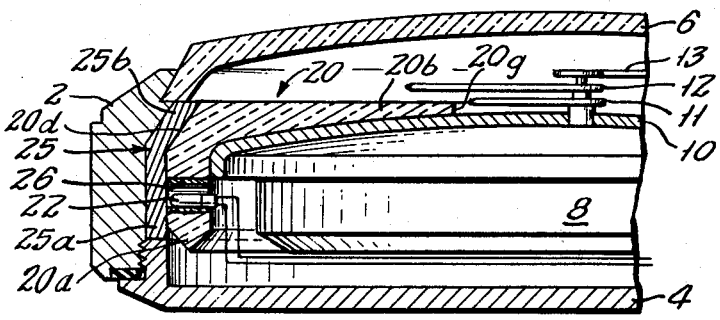
FIG. 3 is similar to FIG. 2 except that a preformed reflector ring is positioned around the dial cap.

FIG. 3 illustrates an especially preferred embodiment of the invention in which a reflector cap 25 is positioned around the light-transmitting dial cap 20. The reflector cap includes a tubular section **25*a* which surrounds tubular section 20*a* of the dial cap and a partial rim section 25*b* which overlies the truncated-conical, light-reflecing surface 20*d* of the dial cap rim section. In certain situations, the rim section 25*b* may extend farther over the dial cap. The interior surfaces of the reflector cap 25 are polished so as to be light-reflecting and thereby minimize leakage of light from the dial cap and enhance distribution of light around the tubular section into the rim section. It will be apparent that the reflector cap may take various forms including a preformed metallic ring positioned around the dial cap (FIG. 3**), a reflective coating such as aluminum on the dial cap or on the interior surfaces of the bezel adjacent the dial cap, or the iterior surfaces of the bezel adjacent the dial cap may be polished to be light-reflecting.

As shown in FIG. 3, an additional reflector 26 may be disposed partially around the incandescent bulb 22 so that light is emitted into the tubular section predominantly in the circumferential direction. This arrangement enchances distribution of light around the tubular section, avoiding a so-called "hot" spot (over-illuminated spot) on the dial portions above the bulb 22 and thus providing more uniform illumination around the dial. The reflector 26 may be a simple sheet metal component, for example aluminum, formed in the desired shape to fit partially around the bulb or it could be metallic coating applied onto the aperture surfaces or the bulb itself.

Figure 4:
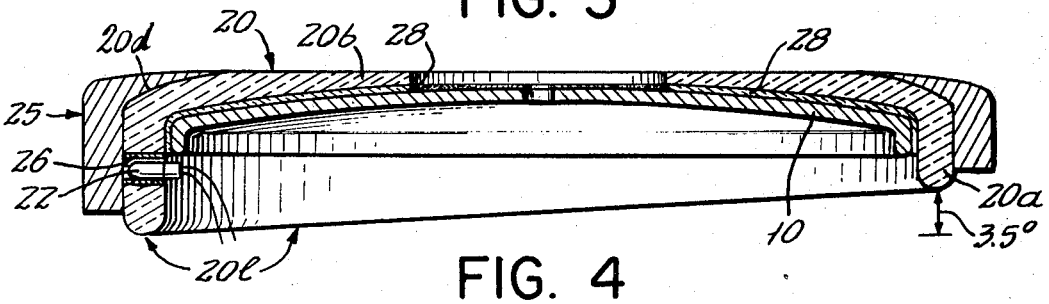
FIG. 4 is a cross-section of one preferred dial illuminator of the invention.

FIG. 4 shows another preferred embodiment incorporating additional features for enhancing the intensity and uniformity of dial illumination. The dial illuminator comprises a light-transmitting dial cap 20 with an annular reflector cap 25 therearound and a reflector 26 partially around the bulb 22. An important feature of the dial cap is that the end 201 of the tubular section **20*a* terminating inside the watch is tapered upwardly, for example at an angle of about 3.5 degrees, toward the dial from the 9 o'clock position where the bulb is located to the 3 o'clock position remote from the bulb. The upwardly converging inner end 201 of the tubular section provides more even distribution of light between the 3 o'clock position and 9 o'clock position. It should be noted that end 201 includes rounded rather than chamfered surfaces to reflect downwardly directed light rays back into the tubular section. Likewise, the outer peripheral surface 20*d*** of the rim section is rounded rather than planar but nevertheless is still considered truncated-conical for light reflecting purposes.

Another important feature of FIG. 4 is the placement of a transparent, light-transmitting material 28 between the rim section **20*b* of dial cap 20 and the dial plate 10. The material 28 may include epoxy or other transparent plastics of either a rigid or resilient nature and functions to provide optimum optical communication between the rim section and dial plate for better light transmission therebetween. The light-transmitting material 28 can be conveniently utilized to attach the dial cap to the dial plate. An alternative technique for effective optimum optical communication between the dial cap 20 and dial plate 10** might be to injection mold the cap directly on and around the dial plate while the latter is fixtured in a suitably configured mold cavity.

Of course, those skilled in the art will appreciate that the dial illuminator is particularly advantageous since the dial cap 20 can be formed inexpensively in large quantities by conventional plastic injection molding techniques. In addition, the reflector cap can be conventionally formed of bent sheet metal or by simply vapor depositing a reflective metallic coating onto appropriate surfaces of the dial cap. And, a conventional dial plate not only of circular but other shapes may be employed with the dial cap readily molded therearound or adhered thereto by adhesive to form a subassembly. Assembly of the other watch components would otherwise follow more or less conventional procedures.

Those skilled in the art will also recognize that increases in the thickness of the watch can be avoided simply by selecting the dimensions of the dial cap such that the rim sections fits in the space between the dial plate and crystal and the tubular section in the space between the dial plate and caseback.

While there have been described herein preferred embodiments of the invention, other modifications may occur to those skilled in the art and it is desired to cover in the appended claims all such modifications as fall within the true spirit and scope of the invention.

I claim:

1. In an analog timepiece having a crystal spaced in front of a dial with time indicator hands supported therebetween on a rotatable shaft, an improved dial illuminator comprising:

(a) a substantially transparent, light-transmitting dial cap diposed behind the crystal, said dial cap having a tubular section disposed around the periphery of the dial and extending axially therebehind with portions thereof behind the dial defining a recess, and an annular rim section projecting from the tubular section over the dial toward its center, said rim section having a light-reflecting outer peripheral surface for reflecting light from the tubular section into the rim section and over the dial and an inner peripheral surface which defines an aperture through which the shaft supporting the time indicator hands passes; and (b) a light source disposed behind the dial in the recess in the tubular section of said dial cap, whereby light from said light source is directed from behind the dial and around its periphery by the tubular section of said dial cap and uniformly over the dial toward its center by said rim section.

2. The dial illuminator of claim 1 wherein the rim section of the dial illuminator includes front and rear surfaces intersecting between said peripheral surfaces and converging toward one another in the direction of the dial center.

3. The dial illuminator of claim 2 wherein the bottom surface of the rim section rests on the dial and is shaped to match the contour of said dial.

4. The dial illuminator of claim 1 wherein a transparent light-transmitting material is placed between the rim section and dial to provide initimate optical communication therebetween.

5. The dial illuminator of claim 1 wherein the recess in the tubular section extends radially therethrough and reflector means is positioned partially around the light source in said recess such that a majority of light is emitted into the tubular section in the circumferential direction.

6. In an analog timepiece having a crystal spaced in front of a dial with time indicator hands supported therebetween on a rotatable shaft, an improved dial illuminator comprising;

(a) a substantially transparent, light-transmitting dial cap disposed behind the crystal, said dial cap having a tubular section disposed around the periphery of the dial and extending axially therebehind with portions thereof behind the dial defining a recess, and an annular rim section projecting from the tubular section over and in contact with the dial toward its center, said rim section having an axially aligned aperture through which the shaft supporting the time indicator hands passes;

(b) a reflector cap disposed around the light-transmitting dial cap, said reflector cap having a light-reflecting tubular section adapted to surround the tubular section of said dial cap and a light-reflecting rim section extending inwardly so as to overlie a portion of the rim section of the dial cap; and (c) a light source disposed behind the dial in the recess in said tubular section, whereby light from said source is directed from behind the dial and around its periphery via the tubular section of said dial cap and uniformly over the dial toward its center via said rim section, said reflector cap minimizing leakage of light from said dial cap and directing light from said tubular section into said rim section.

7. The dial illuminator of claim 6 wherein the rim section of said dial cap and reflector cap have an outer and inner peripheral surface, respectively, which are truncated conical in shape to reflect light from the tubular section of said dial cap into the rim section.

8. The dial illuminator of claim 7 wherein the rim section of the dial cap has front and rear surfaces which converge toward one another in the direction of the dial center, said rear surface resting on the dial and being contoured to match the dial contour.

9. The dial illuminator of claim 8 wherein a transparent light-transmitting material is placed between the rear surface of the rim section and the dial to provide intimate optical communication therebetween.

10. The dial illuminator of claim 6 wherein the reflector cap is in the form of a metallic coating on the dial cap.

11. The dial illuminator of claim 6 wherein the recess in the tubular section of said dial cap extends radially therethrough and reflector means is positioned partially around the light source in said recess so that a majority of light is emitted into the tubular section in the circumferential direction.

12. An improved dial illuminator for an analog timepiece having a crystal spaced in front of a circular dial with time indicator hands supported therebetween on a rotatable shaft, comprising:

(a) a cylindrical molded substantially transparent, light-transmitting plastic dial cap having a tubular section adapted to fit around the periphery of the dial and extend axially therebehind with portions behind the dial defining a radially oriented recess therethrough, and an annular rim section adapted to project from the tubular section over and in contact with the dial toward its center behind said crystal, said rim section having a truncated-conical outer peripheral surface for reflecting light from the tubular section into the section and an upright inner peripheral surface defining an axially aligned aperture through which the shaft supporting the time indicator hands passes with front and rear surfaces intersecting between said peripheral surfaces; said front and rear surfaces converging toward one another in the direction of the dial center; and (b) an incandescent light bulb disposed behind the dial in the recess in said tubular section, whereby light from said bulb is directed fom behind the dial and around its periphery by the tubular section of said dial cap and uniformly over the dial toward its center by said rim section.

13. The dial illuminator of claim 12 wherein a reflector ring is placed around the tubular section and truncated-conical surface of the rim section in the form of a reflective metallic coating thereon.

14. The dial illuminator of claim 12 wherein reflector means is positioned partially around the light bulb in said recess so that a majority of light is emitted into the tubular sectgion in the circumferential direction.

15. The dial illuminator of claim 12 wherein the rear surface of the rim section is contoured to match the contor of the dial.

* * * * *